United States Patent [19]

Brown et al.

[11] Patent Number: 5,060,674

[45] Date of Patent: Oct. 29, 1991

[54] SIDESTREAM SMOKE REDUCING CIGARETTE PAPER WITH IMPROVED PHYSICALS AND IMPROVED SIDESTREAM ODOR/AROMA

[75] Inventors: J. Page Brown, Symna; William F. Cartwright, Roswell; Larry D. Snow, Alpharetta, all of Ga.

[73] Assignee: Kimberly-Clark Corporation, Neenah, Wis.

[21] Appl. No.: 464,462

[22] Filed: Jan. 12, 1990

[51] Int. Cl.[5] ..... A24D 1/02

[52] U.S. Cl. ..... 131/365

[58] Field of Search ..... 131/365; 162/139

[56] References Cited

U.S. PATENT DOCUMENTS

| | | |
|---|---|---|
| 2,181,614 | 11/1939 | Striefling . |
| 3,049,449 | 8/1962 | Allegrini . |
| 3,413,978 | 12/1968 | Brill . |
| 3,744,496 | 7/1973 | McCarty et al. . |
| 4,123,592 | 10/1978 | Rainer et al. . |
| 4,129,134 | 12/1978 | Hind et al. . |
| 4,184,495 | 1/1980 | Rainer et al. . |
| 4,225,636 | 9/1980 | Cline et al. . |
| 4,231,377 | 11/1980 | Cline et al. . |
| 4,236,532 | 12/1980 | Schweizer et al. . |
| 4,461,311 | 7/1984 | Mathews et al. . |
| 4,481,956 | 11/1984 | Chan . |
| 4,643,205 | 2/1987 | Redding et al. . |

FOREIGN PATENT DOCUMENTS

| | | |
|---|---|---|
| 117474 | 10/1977 | Japan . |
| 84-051256 | 1/1985 | Japan . |

OTHER PUBLICATIONS

The Pharmacopeia of the U.S.A., 17th Revision, 9/1/65, pp. 272–273.

The Merck Index, 10th Edition, 1983, p. 647.

*Primary Examiner*—V. Millin

*Attorney, Agent, or Firm*—William D. Herrick

[57] ABSTRACT

Sheet material containing sodium carboxymethyl cellulose especially useful in forming wrappers for smokeable articles such as cigarettes that results in reduced sidestream smoke. The sheet is preferably formed by incorporating as a filler in a cellulosic web an amount of high superficial surface area filler in the range generally of from about 5 to 50 percent by weight in the finished sheet. The cellulosic material may be flax fiber or other natural cellulosic fibers conventionally used for such wrappers. Additional fillers may be used up to a total of about 50 percent, and, preferably, a burn modifier, carboxylic acid salt, preferably a nonhydroxy acid salt such as succinic acid salt is included in an amount of 4 to 15 percent by weight. The sheet can be formed by any conventional papermaking method. When such papers are used as cigarette wrappers, they effect a reduction of the total particulate matter in sidestream smoke of up to about 75 percent with improved taste and odor and without serious deterioration of other desirable properties. In addition, the sheet of the invention provides normal ash appearance in a smoking article.

23 Claims, 4 Drawing Sheets

SIDESTREAM SMOKE REDUCING CIGARETTE PAPER WITH IMPROVED PHYSICALS AND IMPROVED SIDESTREAM ODOR/AROMA

BACKGROUND OF THE INVENTION

1. Field of the Invention

The present invention relates to wrappers for smoking products such as cigarettes. Cigarettes are conventionally made by wrapping tobacco in paper which is made from flax or other cellulosic fibers and calcium carbonate filler. Papers of this general description are standard in today's cigarettes and are available from a number of sources. The burning cigarette releases smoke which may be classified as sidestream when it emanates from the lit-end of the cigarette or mainstream when it is drawn through the tobacco column to the smoker. The present invention is directed to an improved wrapper and resulting smoking article that materially reduce the quantity of sidestream smoke.

2, Description of the Art

Various attempts have been made to reduce the level of sidestream smoke. However, none has been successful to the point of significant commercial exploitation. For example, U.S. Pat. No. 4,225,636 to Cline, et al. issued 30 Sept. 1980 is directed to the use of high porosity carbon-coated cigarette papers disclosed to provide substantial reductions in both mainstream and sidestream smoke. U.S. Pat. No. 3,744,496 to McCarty, et al. issued 10 July 1973 is also directed to a carbon-filled wrapper which is preferably treated with compounds such as alkali metal hydroxides, bicarbonates and carbonates. It also has been recognized that some smoking articles wrapped in tobacco leaf release lower amounts of sidestream smoke, but such wrappers are not practical for use on cigarettes. These products, as well as those resulting from other attempts at sidestream reduction, have suffered either from excessive cost or adverse effects relating to mainstream particulate deliveries, draw, taste, or other factors such as burn rate. U.S. Pat. No. 4,461,311 to Mathews, Mattina and DeLucia dated 24 July 1984 describes a further improvement in wrappers incorporating extraordinary amounts of alkali metal salts. While successfully reducing sidestream smoke, cigarettes with such wrappers have exhibited taste modifications noticeable to some smokers. U.S. Pat. No. 4,805,644 issued 21 Feb. 1989 to Hampl, Fields and Bullwinkel, describes sidestream-reducing cigarette papers having defined surface area characteristics, but which may be further improved in physical properties such as strength. While these improvements have been demonstrated, even better means for reducing sidestream smoke are desired.

As those skilled in this art will appreciate, it is conventional to incorporate any of a wide variety of filler compounds in papers for cigarette wrappers. The above-described U.S. Pat. No. 3,744,496 to McCarty, et al. issued 10 July 1973, for example, discloses the use of carbon as a filler. U.S. Pat. No. 4,461,311 to Mathews, Mattina and DeLucia dated 24 July 1984 teaches the use of calcium carbonate, and a series of patents to Cline or Cline, et al., including U.S. Pat. No. 4,231,377 dated 4 Nov. 1980, teaches the use of various magnesium compound fillers. It has also been suggested that conventional clays may be one of a number of materials suitable as fillers for cigarette wrapper papers. Examples of such teachings include U.S. Pat. No. 2,181,614 to Striefling dated 28 Nov. 1939. Moreover, conventional clays have been taught as suitable for fillers for smokeable compositions, per se. Finally, fillers such as attapulgite clay are known for use in tobacco smoking preparations as taught in U.S. Pat. No. 3,049,449 to Allegrini dated 14 Aug. 1962, for example.

In spite of the foregoing information available to those skilled in this art, it remains desired to obtain reductions in sidestream smoke more efficiently and at the same time improve physical properties of the paper without adverse effects on other smoking properties such as taste or ash color.

SUMMARY OF THE INVENTION

The present invention relates to a wrapper for a smokeable article and to the smoking article, itself, both providing substantial reduction in sidestream smoke without significant adverse effect on properties such as mainstream particulate matter and puff count. These results are obtained by modifying cigarette wrapper paper formulations. The paper formulation is modified to contain a carboxylic acid salt, preferably a nonhydroxy acid such as a succinic acid salt, as well as sodium carboxymethyl cellulose, and in preferred embodiments may include a burn modifier such as monoammonium phosphate. Surprisingly, the wrapper paper as described in the present invention results in a smoking article with very significant reductions in sidestream smoke while achieving the described benefits.

DESCRIPTION OF THE PREFERRED EMBODIMENTS

Figure 1:
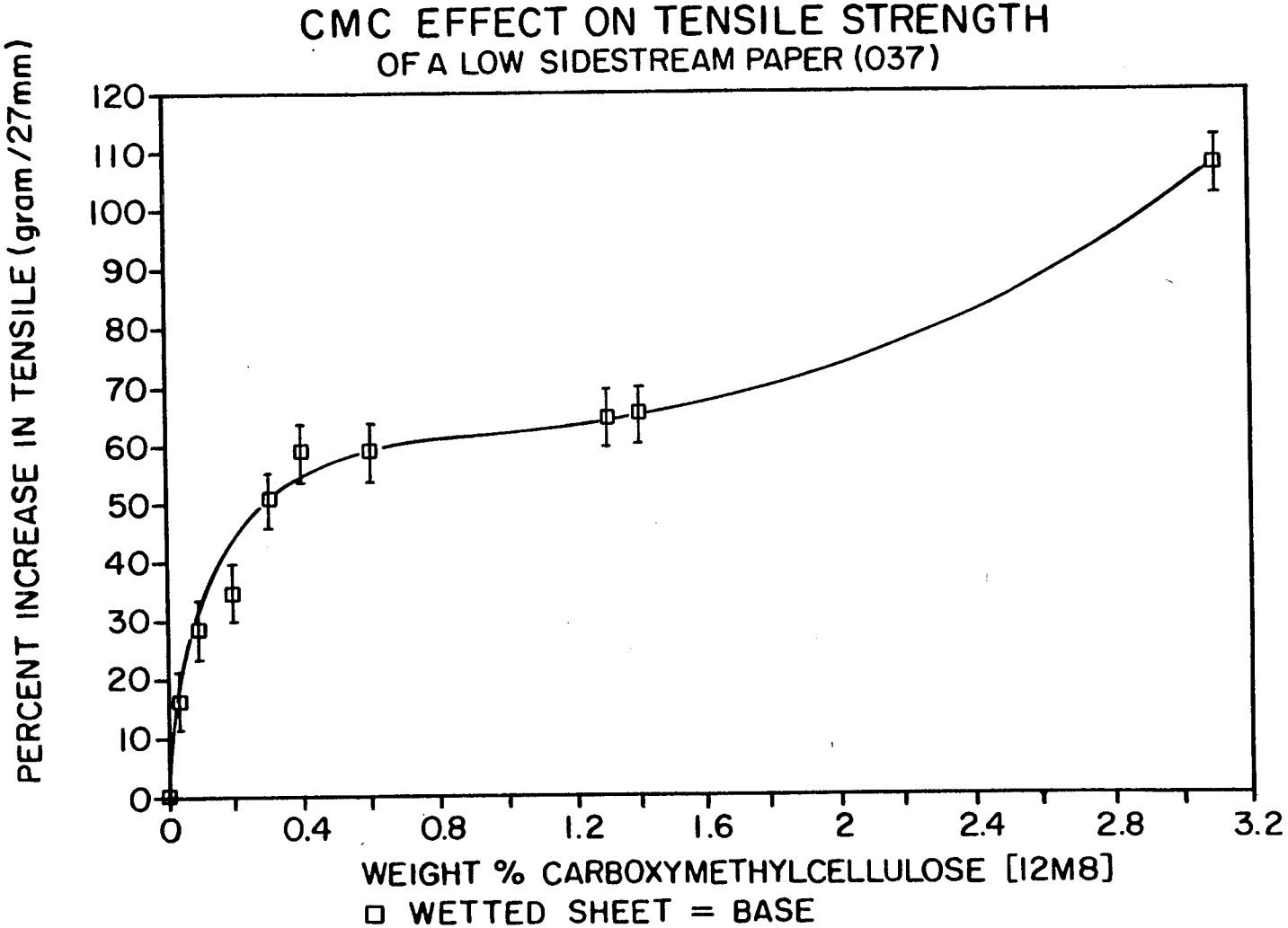
FIG. 1 is a graph illustrating the effect of sodium carboxymethyl cellulose on sheet tensile properties.

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

During the smoking of a cigarette, a large fraction of the total smoke generated by combustion of the tobacco is released from the lit-end of the cigarette as sidestream smoke. The relative amounts of mainstream and sidestream in a given instance will depend upon the manner in which it is smoked. If the cigarette is placed in an ashtray for prolonged intervals between puffs, sidestream becomes a very large fraction of the total smoke produced. Whether the cigarette is held by the smoker or rests in an ashtray during the interval between puffs, the sidestream rises as a concentrated and highly visible plume of smoke. Moreover, this concentrated plume continues to emanate from the lit-end even while air is being drawn in during the puff, so that sidestream smoke is constantly released throughout the consumption of a cigarette, regardless of whether consumption is largely by smoldering or by puffing. At times, the sidestream smoke plume is carried by air currents into the vicinity of other persons who may find it objectionable. Therefore, cigarettes producing markedly less sidestream are highly desirable. Prior attempts have achieved significant reductions, but have been accompanied by perceived adverse effects on taste and odor.

In accordance with the present invention, sidestream smoke particulate matter is greatly reduced by modifications of the paper used to wrap the tobacco column in a manner that beneficially affects taste and odor. Prior attempts to reduce sidestream smoke by wrapper modifications have involved the use of papers which were technically or economically impractical, which modified taste and/or color, which were aesthetically unacceptable, or which resulted in drastically increased mainstream smoke delivery and/or unacceptable puff count. In contrast, the modifications of the present invention do not result in significant changes in burn rate or elevated delivery of mainstream tar compared with conventional cigarettes; they do not adversely affect the taste, odor or appearance of the cigarette or ash; and they do not require the use of exotic materials or manufacturing processes. For example, cigarettes made with the wrapper of the present invention afford normal enjoyment to the smoker but diminish the possibility of stray smoke being objectionable to bystanders.

In accordance with the invention, these highly desirable beneficial effects are obtained by using a sodium carboxymethyl cellulose binder, preferably in combination with a carboxylic salt such as a succinic acid salt and a burn modifier such as monoammonium phosphate in wrapper materials for smokeable articles. Such wrapper materials may otherwise be conventional cigarette papers made from flax and/or other cellulosic fibers containing, if desired, one or more other inorganic fillers, typically calcium carbonate. Other suitable mineral fillers such as clay, alumina and the like, will be apparent to those skilled in this art. Such fillers are useful in a broad range of, for example, 5 percent to about 50 percent of paper by weight in accordance with this invention. The sodium carboxymethyl cellulose may be included within the range of from about 0.1 to 7.0 percent by weight with the range of from about 0.3 to 1.5 percent by weight being preferred. The carboxylic acid salt may be included in the range of from about 4% to about 15% by weight with the range of from about 4% to about 12% preferred.

While the use of fillers and carboxylic acid salts has been known for many years as additives to cigarette papers for the purposes of improving burn characteristics, such conventional use does not normally include sodium carboxymethyl cellulose, particularly in combination with succinic acid or salts and a burn modifier. The remainder of the paper composition in accordance with the invention will comprise conventional materials such as cellulose fibers, preferably flax, other fillers and burn modifiers.

While it is not desired to limit the invention to any particular theory, it is believed that the particular paper compositions described in this invention function by avoiding the production of low molecular weight aldehydes and ketones during smoulder. Salts of hydroxy acids, under pyrolytic conditions obtained during smoulder, may eliminate water across the appropriate carbon-to-carbon bond. This elimination could result in an unsaturated linkage which, through subsequent oxidative cleavage, could generate the low molecular weight aldehydes and ketones that are known irritants. On the other hand, a salt of a non-hydroxy acid such as succinic acid would not be expected to favor production of such irritants. Other nonhydroxy acid salts such as acetates, for example, may also be used. Table 1 provides sensory evaluation data comparing citrates and succinates as wrapper additives.

The nature and origin of this visible smoke may be understood by considering it as a fog, i.e., a suspension of small liquid droplets in a gas phase, resulting from the supercooling and spontaneous nucleation of the vapor phase of certain high boiling compounds generated in the above-mentioned destructive distillation process that occurs during smoulder. Once such a fog is formed, it exhibits great stability and can only be depleted of its liquid droplet content by highly efficient mechanical filtration means. In the practice of the preferred embodiments of the present invention, this supercooling and spontaneous nucleation of the vapor phase is greatly diminished by incorporating certain fillers in the paper wrapper as described in the above-mentioned U.S. Pat. No. 4,805,644 issued 21 Feb. 1989 to Hampl, Fields and Bullwinkel. These fillers function by providing enlarged condensing surface areas resulting in a large fraction of the fog droplet precursor vapors condensing as liquid layers on the cooler filler particle surfaces. Such phase transformations (gas-liquid) are extremely rapid and efficient, thus relieving the requisite supersaturation necessary for fog (smoke) generation.

It might be expected that this condensing mechanism would offer only temporary and inconsequential relief from smoke generation since the ever-advancing coal will soon re-boil these condensed liquids to yield the original vapors which are responsible for smoke generation in the first place. However, when this occurs, the re-boiling takes place on the outer periphery of the cigarette, where the ambient environment (air) is much enhanced in oxygen content compared to the interior of the cigarette where the vapors were first generated. Because of this enhanced oxygen content, these vapors are believed to be efficiently burnt or broken down to gaseous products which do not nucleate under normal smoking conditions to form visible smoke on cooling because of their lower molecular weight.

As described herein throughout the body of this document, percent sidestream reduction results are demonstrated with reference to a control cigarette made with a conventional cigarette paper. This paper is characterized by a permeability of 30 cm/min (as measured by the CORESTA method at a pressure differential of 1 centibar), a basis weight of 25 g/m$^2$, a filler content of 30 percent chalk, a fiber content of 69 percent flax, and a burn promoter mixture of 0.3 percent potassium citrate and 0.6 percent sodium citrate. (The superficial surface area of the chalk in the control wrapper is only 6 m$^2$/g.) Both the control cigarettes and cigarettes made in accordance with the invention wrappers contained the same standard tobacco blend obtained from American Tobacco Company designated "Lucky Strike" blend with a bulk density of 0.265 g/cm$^3$.

Thermal Stability of the Filler Structure

The filler preferably has a large surface area which does not decrease significantly during heating of the filler as the hot coal approaches and passes by. Some fillers, which have a large surface area at room temperature, fail to satisfy this requirement due to melting, fusing, or collapse of the filler particles. For example, the total surface area of a filler, Silcron 900, a silica hydrogel manufactured by SCM Pigments Corporation, decreases drastically following exposure to elevated temperatures (from 47 $m^2/g$ to 6 $m^2/g$ following heating to 400° C.). Such fillers are described in the above-mentioned co-assigned U.S. Pat. No. 4,805,644 issued 21 Feb. 1989 to Hampl, Fields and Bullwinkel, which is incorporated herein by reference.

It should not be inferred from the foregoing that all thermally unstable fillers lose surface area during heating. Some fillers behave just the opposite and comprise an important class of sidestream smoke reducing fillers. These fillers in general are certain crystalline solids which on heating to modest temperatures chemically decompose to form new crystalline phases, which differ in density from that of the original solid. When this transformation occurs, the original crystals shatter and generate additional surface area. Examples of these fillers are hydrates ($CaSO_4.2H_2O$), hydroxides ($Ca(OH)_2$), carbonates ($MgCO_3$), and peroxides ($MgO_2$). These compounds thermally decompose to yield a new crystalline phase and a gaseous byproduct ($H_2O$, $CO_2$, or $O_2$) in the temperature range of 200 to 500° C. To realize the advantage of this thermally generated surface area there must not be any liquid phase (such melting or eutectic formation) during the transformation. If this is not the case, the liquid will serve to sinter the filler particles together and lead to an actual decrease in surface area.

EXAMPLES OF SUITABLE FILLER COMPOSITIONS (1) Clays

Attapulgite clay. This clay possesses a thermally stable, superficial surface area (200 $m^2/g$) which far exceeds that of more conventional clays, such a kaolinite or bentonite. (2) Oxides Fumed silica and alumina. Both of these oxides formed by burning of their respective chlorides have enormous superficial surface areas (200–600 $m^2/g$) and are thermally stable. This characteristic should be contrasted to that for more conventional hydrated silicas which collapse during heating and thereby lose their effectiveness in reducing sidestream smoke. (3) Peroxides Peroxides of magnesium, calcium and strontium can be used in this invention. They all decompose thermally at modest temperatures to yield increased superficial surface areas. (4) Carbonates Carbonates of magnesium, calcium, strontium and barium, which possess superficial surface areas exceeding about 20 $m^2/g$, can be used in this invention. (These carbonates can be distinguish from the conventional carbonates of commerce, which possess a superficial surface area $<10$ $m^2/g$.). (5) Phosphates Phosphates of magnesium, strontium, calcium and barium, which possess superficial surface areas exceeding about 20 $m^2/g$, can be used in this invention. (6) Sulphates Sulphates of calcium, strontium and barium, which possess superficial surface areas exceeding about 20 $m^2/g$, can be used in this invention. (7) Aluminates Aluminates of magnesium, calcium, strontium, and barium, which possess superficial surface areas exceeding about 20 $m^2/g$, can be used in this invention. (8) Silicates Silicates of magnesium, calcium, strontium, barium, sodium, and potassium, which possess superficial surface areas exceeding about 20 $m^2/g$, can be used in this invention. Preferably those sodium and potassium silicates which are water insoluble can be used.

Effect of Carboxylic Acid Salts

In addition to providing a large condensing surface the present invention also preferably includes the presence in the wrapper of certain additives which serve to generate a coherent and continuous ash. This is achieved by incorporating carboxylic acid salts into the paper, preferably at a level of 4 to 15 percent with 6 to 12 percent particularly preferred. These salts function by light sintering not only the char of the partially decomposed paper also that of the final inorganic ash. If such salts are not provided, both the char and the ash structures will exhibit large cracks and fissures. Since in the interior of the cigarette the generated gases are at an appreciable positive pressure, they will preferentially escape through such fissures, completely bypassing the condensing surfaces of the filler. This obviously will vitiate the efficacy of the condensing sites. However, once the benefit obtained from the elimination of fissures is achieved, additional amounts of carboxylic acid salt will result in loss of surface area due to excessive sintering of the filler particles. Thus provision of an excess of a carboxylic acid salt ($>15\%$) will actually worsen sidestream smoke reduction. In contrast to other carboxylic acid salts, succinic acid salts have been shown to enhance taste and aroma effects and are, therefore, preferred.

Wrapper Manufacture

Manufacture of the wrapper materials may be accomplished using standard papermaking processes suitable for the furnishes described herewith. These methods are known and will not be further described.

EXAMPLES

Example 1

A control cigarette was formed using a Hauni Baby Cigarette Maker. The cigarette was 70mm in length and had a standard 8mm diameter and tobacco density of 0.265 g/cc. The wrapper was a conventional sheet having a basis weight of 25 $g/m^2$ and comprised flax fibers plus 28–30% Albacar chalk from Pfizer and 0.8% sodium and potassium citrate by weight as a mixture 3 parts sodium citrate to one part potassium citrate.

Example 2

A cigarette was formed as in Example 1 except that the wrapper had a basis weight of about 45 gsm and contained 2 percent by weight sodium carboxymethyl cellulose ("CMC") added by impregnating with a carboxymethyl cellulose aqueous composition to the desired add-on. Also, the filler used in the paper was 35% by weight fine particle chalk (Multifex MM from Pfizer) and no citrate was used.

Example 3

A cigarette was formed as in Example 2 except that the wrapper contained 5 percent by weight di-potassium succinate ("potassium succinate") added by impregnating the wrapper with an aqueous potassium succinate composition.

Example 4

Example 3 was repeated except that the wrapper also contained 0.5 percent sodium carboxymethyl cellulose.

Example 5

Example 3 was repeated except that the wrapper also contained 0.3% sodium carboxymethyl cellulose and 0.5% monoammonium phosphate ("MAP").

Example 6

Example 3 was repeated except that the level of potassium succinate contained by the wrapper was increased to 12 percent, and the wrapper also contained 1.5 percent sodium carboxymethyl cellulose and 3 percent monoammonium phosphate.

Example 7

Example 3 was repeated except that the level of potassium succinate was increased to 10 percent and the filler used in the paper was Degussa Corporation fumed alumina in an amount of 12 percent by weight plus conventional Albacar chalk in the amount of 18% by weight.

Example 8

Example 7 was repeated using alumina filler containing paper and a wrapper containing 8 percent potassium succinate, 1.5 percent sodium carboxymethyl cellulose, and 5 percent monoammonium phosphate.

Example 9

Example 8 was repeated except that potassium citrate was substituted for potassium succinate.

Example 10

Example 9 was repeated except that the potassium citrate level was increased to 10 percent, and the monoammonium phosphate level was increased to 6 percent.

Example 11

Example 6 was repeated using a paper containing 16 percent of a clay filler (Attagel 4C attapulgite from Englehard Chemicals Co.) plus 18% conventional chalk and containing 10 percent potassium succinate, 1.5 percent sodium carboxymethyl cellulose, and 2 percent monoammonium phosphate.

Example 12

Example 6 was repeated using a paper containing 35 percent of a fine particle chalk filler (Multifex MM from Pfizer) and a wrapper containing 11.5 percent potassium citrate, 1.2 percent sodium carboxymethyl cellulose, and 2.9 percent monoammonium phosphate.

Example 13

Example 12 was repeated except that no monoammonium phosphate was included in the wrapper which contained 12.8 percent potassium citrate and 0.7 percent sodium carboxymethyl cellulose. Table 2 provides a summary of smoke data for cigarettes in accordance with Examples 1–13.

Example 14

The paper in Example 15 containing 8.1% potassium succinate, 0.8% sodium carboxymethyl cellulose, 3.0% monoammonium phosphate. The sidestream TPM was reduced 38% and the puff count was 6.5.

Example 15

The paper as in Example 2 containing 45 gsm sheet with 35% high surface area chalk, 7.9% potassium succinate, 1.4% monoammonium phosphate, 0.6% guar gum. The sidestream TPM was reduced 46% and the puff count was 7.2.

TABLE 1

SENSORY EVALUATION OF CIGARETTE PAPERS TREATED WITH SUCCINATE AND CITRATE BURN CONTROL SALTS

| PAPER | IRRITATION (10 = WORST) | | ODOR (10 = HIGHEST) | | ODOR PLEASANTNESS (10 = BEST) | |
|---|---|---|---|---|---|---|
| TYPE | CITRATE | SUCCINATE | CITRATE | SUCCINATE | CITRATE | SUCCINATE |
| Softwood - 1 | 7 | 3 | 4.4 | 3 | 4 | 6 |
| Softwood - 2 | 7.5 | 4.5 | 5 | 4 | 4 | 5 |
| Flax - 1 | 6.8 | 3.9 | 5 | 3.8 | 3.5 | 5.4 |
| Flax - 2 | 5.9 | 4.5 | 5 | 3.9 | 4.1 | 5 |

Notes:
1. Evaluations were conducted in duplicate using five panelists in four sessions over two days.
2. Citrate and succinate levels were matched for each pair.

TABLE 2

| EXAMPLE | SAMPLES | Sidestream TPM (mg) | Puff COUNT | % Sidestream REDUCTION |
|---|---|---|---|---|
| 1 | Control | 26 | 8 | — |
| 2 | 2% CMC | 11 | 8 | 57 |
| 3 | 5% di-potassium succinate ("KS") | 15 | 7.5 | 44 |
| 4 | 5% KS/.5% CMC | 16 | 7.5 | 40 |
| 5 | 5% KS/.3% CMC/.5 MAP | 15 | 7.5 | 44 |
| 6 | 12% KS/1.5% CMC/3% MAP | 10.4 | 8.0 | 60 |
| 7 | Same as 3 but alumina filler | 10.0 | 6.2 | 57 |
| 8 | Same as 7 but 8% KS, 15% CMC/5% MAP | 10.9 | 8.0 | 54 |
| 9 | Same as 8 but tri-potassium citrate ("KC") for KS | 11.4 | 7.5 | 51 |
| 10 | Same as 9 but 10% KC and 6% MAP | 10.2 | 7.0 | 56 |

TABLE 2-continued

| EXAMPLE | SAMPLES | Sidestream TPM (mg) | Puff COUNT | % Sidestream REDUCTION |
|---|---|---|---|---|
| 11 | Same as 6 but attapulgite clay filler 10% KS, 1.5% CMC/2% MAP | 8.2 | 10.3 | 65 |
| 12 | Same as 6 but 11.5% KC 1.2% CMC and 2.9% MAP | 12.7 | 7.0 | 51 |
| 13 | Same as 12 but no MAP, 12.8% KC and 0.7% CMC | 14.0 | 6.0 | 46 |

Modifying any conventional cigarette paper formulation by the addition of such sodium carboxymethyl cellulose in accordance with the invention results in a decrease in the level of sidestream smoke. Also, further improvements result when the treatment includes a salt such as potassium succinate and a burn modifier such as monoammonium phosphate. However, the effect of this treatment can be maximized by using paper with high surface area fillers, low porosity, and by maintaining sheet bulk at a high level consistent with low porosity. For a given level of filler addition, lower porosity causes further decreases in sidestream smoke. In accordance with preferred embodiments of the invention, the paper porosity is in the range of from 2 to 30. The porosities are expressed as CORESTA permeability (superficial velocity, in centimeters per minute, of air flowing through a porous paper at a pressure differential of one centibar).

While the examples are illustrated using calcium carbonate, alumina and clay as fillers, other fillers may be used in combination with the high superficial surface area filler or it may constitute the only filler. Also, the burn enhancer may vary as to composition and amount; for example, acetates and citrates may be used, and in amount, for example, from about 4 percent up to about 15 percent by weight, or it may be omitted entirely.

Turning to FIG. 1, the graph shows percent tensile strength increase plotted against weight percent CMC. This illustrates that CMC has a dramatic effect on increasing tensile strength, particularly at lower levels in accordance with the invention.

Figure 2:
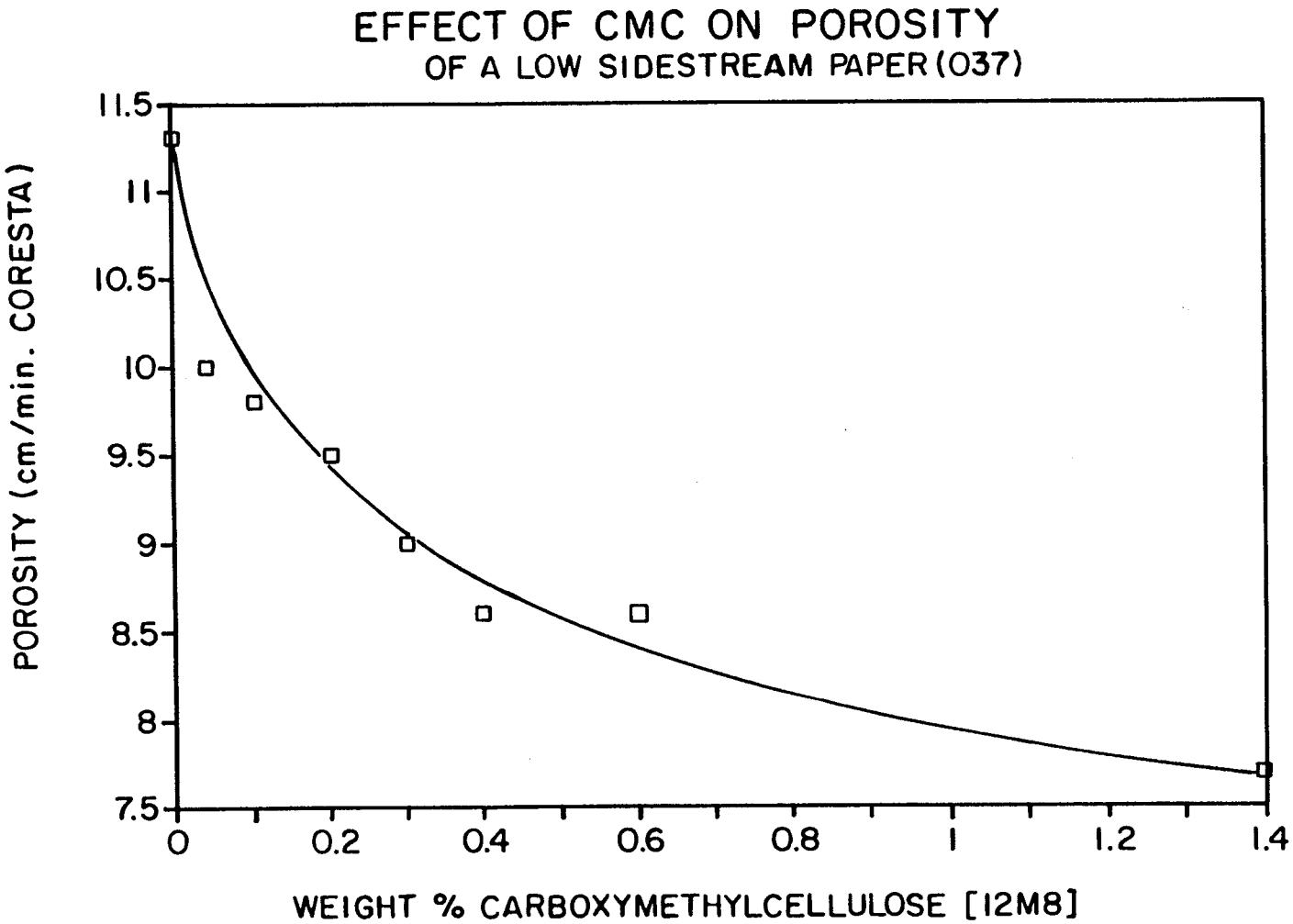
FIG. 2 is a graphic representation like that of FIG. 1 showing the effect of using sodium carboxymethyl cellulose in accordance with the present invention on CORESTA porosity.

Turning to FIG. 2, the graph shows porosity as a factor of CMC addition. This illustrates that, particularly at lower levels, rapid decreases in porosity are obtained in accordance with the invention.

Figure 3:
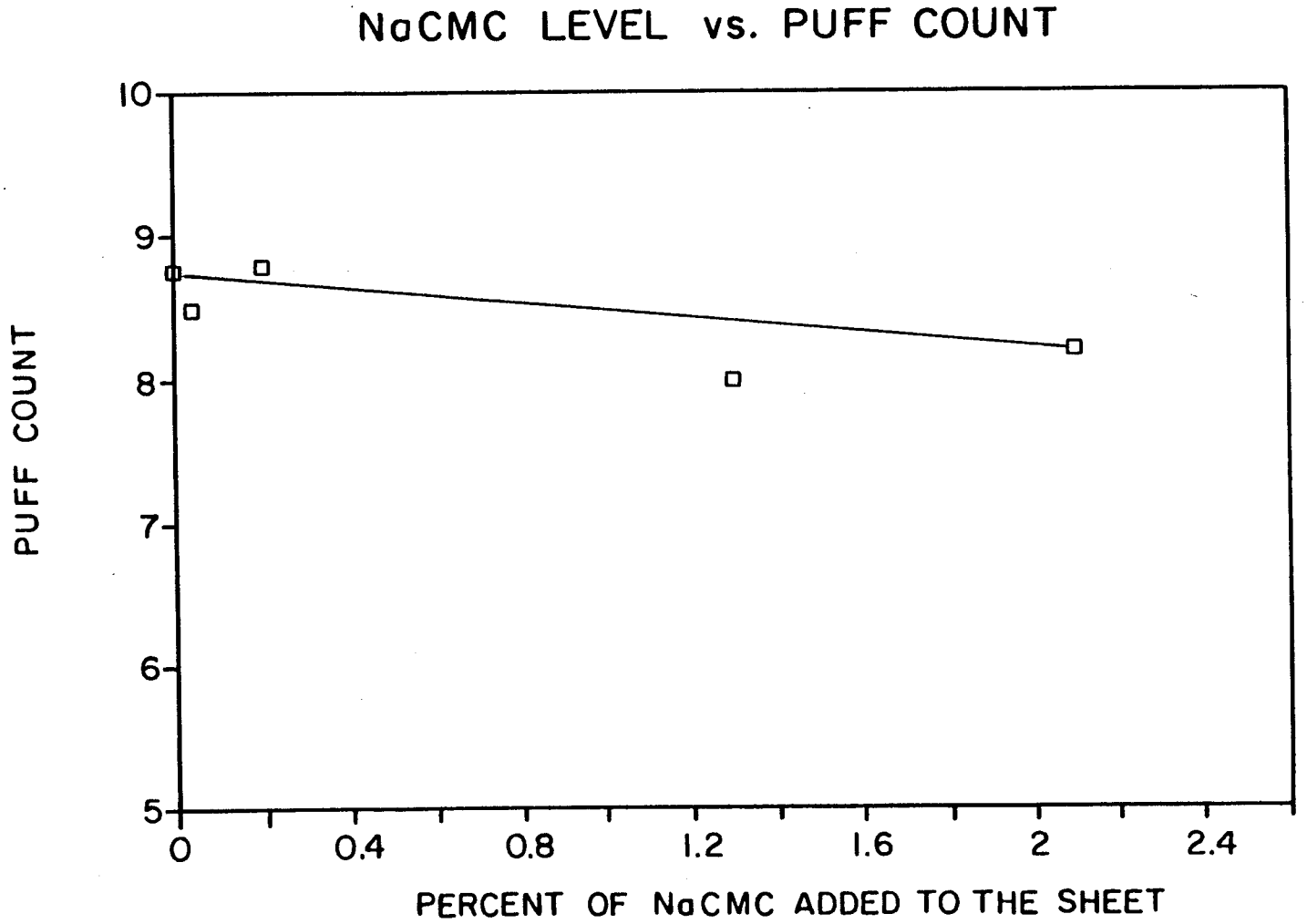
FIG. 3 is a graph illustrating effects on puff count.
Figure 4:
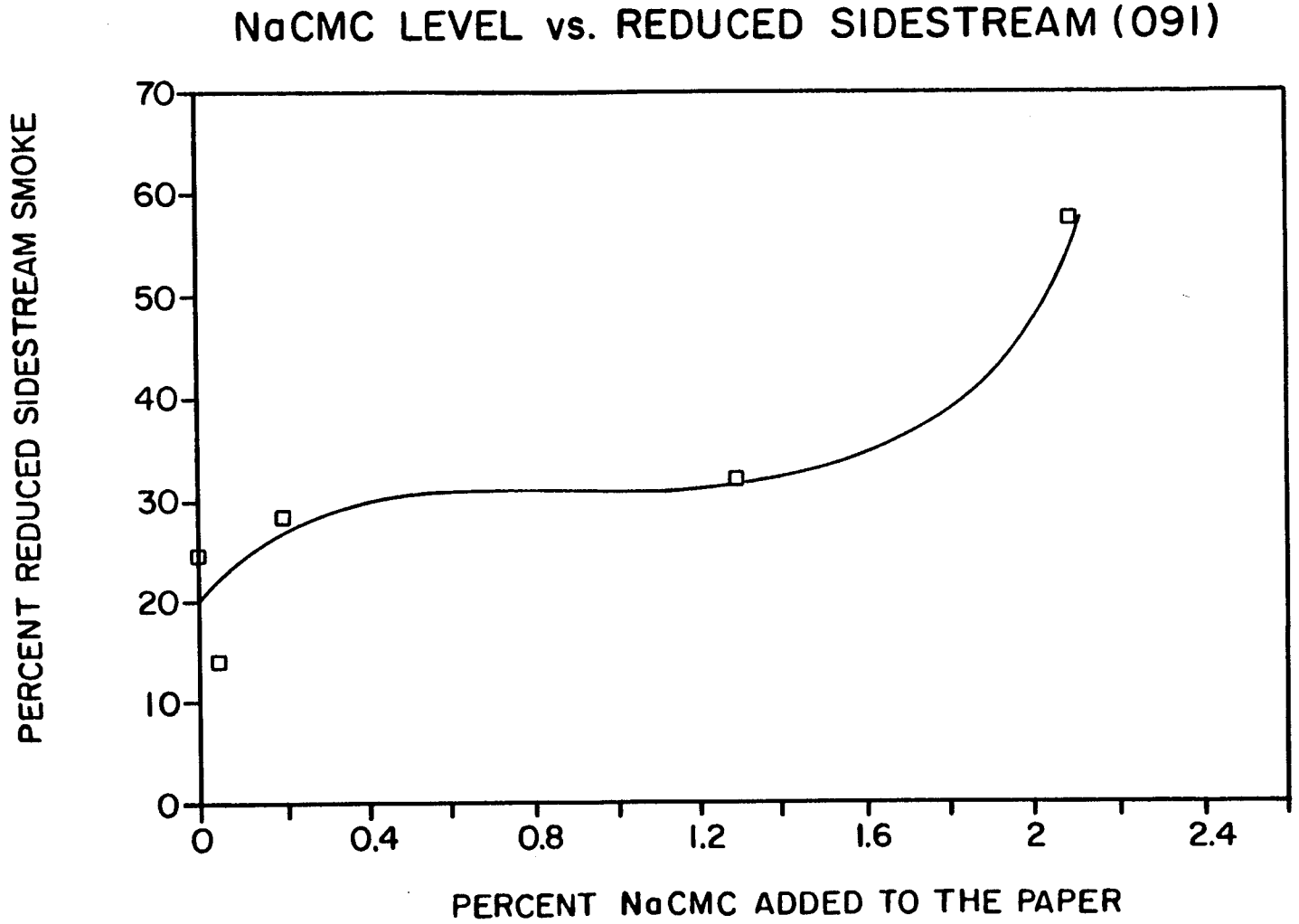
FIG. 4 is a graph illustrating the effect of addition of sodium carboxymethyl cellulose on reducing sidestream smoke in accordance with the invention.

Turning to FIG. 3, it can be seen that CMC addition gradually reduces puff count, and FIG. 4 demonstrates that, in accordance with the invention, CMC produces increased sidestream reduction.

Thus, it is apparent that there has been provided, in accordance with the invention, a sheet material adapted for use as a wrapper for smoking articles that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. In a paper adapted for use as a wrapper for smoking articles, said paper comprising cellulose fibers, an inorganic filler, and a burn modifying salt, the improvement wherein said paper also includes a carboxylic acid salt and sodium carboxymethyl cellulose in amounts effective to achieve sidestream reduction in a smoking article.

2. The paper of claim 1 wherein the carboxylic acid salt is a nonhydroxy acid salt and the inorganic filler has a superficial surface area in excess of about 20 square meters per gram.

3. The paper of claim 2 wherein the carboxylic acid salt is selected from the group consisting of succinates and acetates and the filler is selected from the group consisting of attapulgite clay, fumed slica and alumina, peroxides of magnesium, calcium and strontium, carbonates of magnesium, calcium and strontium, phosphates of magnesium, strontium, and barium, sulfates of calcium, strontium and barium, aluminates of magnesium, calcium, strontium, and barium, and silicates of magnesium, calcium, strontium, barium, sodium, and potassium and wherein the filler is included in an amount within the range of from about 5% to about 50% by weight.

4. The paper of claims 1, 2, or 3 wherein the carboxylic acid salt is included in an amount within the range of from about 4% to about 15% by weight.

5. The paper of claim 4 wherein the carboxylic acid salt is included in an amount within the range of from about 6% to about 12% by weight.

6. The paper of claim 4 wherein the sodium carboxymethyl cellulose is included in an amount within the range of from about 0.1% to about 7.0% by weight.

7. The paper of claim 5 wherein the sodium carboxymethyl cellulose is included in an amount within the range of from about 0.3% to about 1.5% by weight.

8. The paper of claim 6 wherein carboxylic acid salt is included in the form of the potassium salt in an amount within the range of from about 4% to about 12% by weight.

9. The paper of claim 7 wherein the carboxylic acid salt is included in the form of the potassium salt in an amount within the range of from about 4% to about 12% by weight.

10. The paper of claim 8 having a CORESTA porosity in the range of from about 2 to about 30.

11. The paper of claim 9 having a CORESTA porosity in the range of from about 2 to about 30.

12. The paper of claim 10 wherein the burn modifier includes monoammonium phosphate.

13. The paper of claim 11 wherein the burn modifier includes monoammonium phosphate.

14. The paper of claim 10 wherein the burn modifier includes a mixture of potassium citrate and sodium citrate.

15. The paper of claim 11 wherein the burn modifier includes a mixture of potassium citrate and sodium citrate.

16. The paper of claim 14 wherein the mixture includes about 0.3% potassium citrate and about 0.6% sodium citrate by weight based on the paper.

17. The paper of claim 15 wherein the mixture includes about 0.3% potassium citrate and about 0.6% sodium citrate by weight based on the paper.

18. A smoking article comprising a smokable rod wrapped with the paper of claim 12.

19. A smoking article comprising a smokable rod wrapped with the paper of claim 13.

20. A smoking article comprising a smokable rod wrapped with the paper of claim 14.

21. A smoking article comprising a smokable rod wrapped with the paper of claim 15.

22. A smoking article comprising a smokable rod wrapped with the paper of claim 16.

23. A smoking article comprising a smokable rod wrapped with the paper of claim 17.

* * * * *